United States Patent [19]

Kilroy

[11] Patent Number: 4,609,457

[45] Date of Patent: Sep. 2, 1986

[54] OPERATION OF CONTINUOUS EXTRACTION PROCESS

[75] Inventor: James W. Kilroy, Arcadia, Tex.

[73] Assignee: UOP Inc., Des Plaines, Ill.

[21] Appl. No.: 706,539

[22] Filed: Feb. 27, 1985

[51] Int. Cl.[4] ..... C10G 21/02

[52] U.S. Cl. ..... 208/311; 208/DIG. 1; 203/3; 210/97

[58] Field of Search ..... 208/311, 325, 321, 332, 208/DIG. 1, 339; 210/97, 103, 104, 105, 739, 740, 744; 203/3; 196/14.52

[56] References Cited

U.S. PATENT DOCUMENTS

| | | | |
|---|---|---|---|
| 2,336,205 | 12/1943 | Willauer | 208/311 |
| 2,367,671 | 1/1945 | Dickinson et al. | 208/311 |
| 2,474,006 | 6/1949 | Maycock | 196/14.52 |
| 2,609,277 | 9/1952 | McNamara | 196/14.52 X |
| 2,729,549 | 1/1956 | Reman | 208/311 |
| 2,776,329 | 1/1957 | Mayeux, Jr. | 196/14.52 X |
| 3,037,062 | 5/1962 | Gerhold | 260/674 |
| 3,433,735 | 3/1969 | Broughton | 208/325 |
| 3,435,087 | 3/1969 | Broughton | 260/274 |
| 3,443,692 | 5/1969 | Halsey | 210/97 |
| 3,470,088 | 9/1969 | Vickers | 208/325 |
| 3,546,107 | 12/1970 | Brown et al. | 208/DIG. 1 |
| 3,558,480 | 1/1971 | Broughton | 208/325 X |
| 3,642,614 | 2/1972 | Van Tassell | 208/321 |
| 3,864,245 | 2/1975 | Van Tassell | 208/321 |
| 4,201,626 | 5/1980 | Asdigian | 196/14.52 |
| 4,305,907 | 12/1981 | Baird | 196/14.52 X |

OTHER PUBLICATIONS

John H. Perry, *Chemical Engineers' Handbook*, 4th edition, McGraw-Hill, pp. 14–40, through 14–43.

*Primary Examiner*—Andrew H. Metz
*Assistant Examiner*—Glenn A. Caldarola
*Attorney, Agent, or Firm*—Thomas K. McBride; John F. Spears, Jr.; Richard J. Cordovano

[57] ABSTRACT

Method of operation for a continuous countercurrent extraction zone, to which a charge mixture stream and a solvent stream are continuously supplied and from which an extract stream and a raffinate stream are continuously withdrawn. In one embodiment, the method comprises establishing a recycle stream consisting of a portion of the light phase stream withdrawn from the column, combining the recycle stream with the charge mixture stream, and controlling the streams flowing to and from the column. The combined feed stream to the extraction zone is controlled at a constant flow rate and recycle flow has preference over charge mixture flow, thereby causing charge stream flow to vary inversely with recycle flow. An important feature of the invention resides in adjustment of composition of this total combined feed stream to the extraction zone in order to deal with fluctuations in other parameters. The effects of fluctuations in flow rates and compositions of streams entering and leaving an extraction zone are mitigated, resulting in increased efficiency.

20 Claims, 4 Drawing Figures

OPERATION OF CONTINUOUS EXTRACTION PROCESS

FIELD OF THE INVENTION

This invention relates to liquid-liquid extraction. More specifically, it relates to a continuous countercurrent zone. In particular, the present invention encompasses methods of operation and control systems for such zone.

BACKGROUND OF THE INVENTION

Liquid-liquid extraction zones are extremely sensitive to fluctuations in flow rates and compositions of streams entering and leaving the zone. These fluctuations often result in process upsets which cause production of the desired products to be reduced or stopped, since the product streams are no longer at the desired compositions. Disturbances, or upsets, in an extraction zone cause upsets in the downstream equipment which purifies and further processes extraction zone product streams, thus adding to the problem of off-specification product and further aggravating the upset of the extraction zone by means of changes in reflux streams, if any, and changes in the solvent stream which is returned to the extraction zone for reuse after its separation from an extraction zone product stream. A common result of fluctuations is known to those skilled in the art as stacking, which is an increase in inventory of a substance in an extraction zone. The present invention is particularly adapted to mitigate stacking.

Commonly used automatic control schemes simply attempt to maintain all flows at constant values and assume that constant flows yield constant composition values. In conjunction with such automatic control systems, an operator must make adjustments in response to various fluctuations, including fluctuations in composition. However, such adjustments can only be made after a fluctuation is detected. Thus, fluctuations in flows and compositions of a magnitude sufficient to seriously affect an extraction zone are inevitable. Such fluctuations are frequently caused by performance of routine maintenance, flow rate changes, temperature changes and changes in charge mixture composition. As will be described below, a commonly used control scheme will actually aggravate certain problems rather than solving them, such as where the automatic controls cause raffinate to be removed from an extraction zone in a situation where raffinate should remain or be returned to the zone, in order to maintain relatively constant conditions in the zone, i.e., to maintain a constant composition profile.

Prior art methods of operation of extraction zones usually results in constantly changing compositions. As soon as a product composition, for example, moves off-specification, an adjustment is made. The adjustment causes the product composition to move toward the desired point and then to move away from it again in another direction. When the new excursion is detected, another adjustment is made. System parameters are continuously moving, within ranges whose span is determined by the quantity and quality of the corrective adjustments. It can be said that the system is constantly rocking back and forth. Thus the composition profile in the extraction zone is constantly shifting, increasing operating cost and lessening product quality.

BRIEF SUMMARY OF THE INVENTION

The invention is a method of operation for a continuous countercurrent extraction zone, to which a charge mixture stream and a solvent stream are continuously supplied and from which an extract stream and a raffinate stream are continuously withdrawn. The method cmprises establishing a recyle stream consisting of a portion of the light phase stream withdrawn from the column, combining the recycle stream with the charge mixture stream, and controlling the streams flowing to and from the column. An important feature of the invention resides in adjustment of composition of this total combined feed stream to the extraction zone in order to deal with fluctuations in other parameters. Briefly, the streams flowing to the extraction zone are flow-controlled. The recycle flow is variable, thereby causing the charge mixture flow to vary inversely with it, since the total combined stream is flow-controlled at a constant rate. Heavy phase flow out of the extraction zone is under interface level control and the portion of the light phase stream remaining after the recycle stream is divided out and is flow-controlled. The recycle stream varies in order to maintain the extraction zone inventory, i.e., is the "uncontrolled" variable. In this manner, the composition profile within the zone is stably maintained.

It is an object of this invention to provide a method of operation for an extraction zone which reduces the duration of upset conditions and thereby increases production and reduces cost.

It is an object of this invention to provide a control scheme and method of operation which responds in a positive manner to minimize the effects of fluctuations, thereby returning operation to normal in a more rapid manner than is possible with prior art methods.

It is a further object of this invention to provide a method of operation which improves the control of composition of the raffinate stream in situations where extract composition control is of primary importance or, where raffinate composition is of primary importance, improves the control of extract composition.

Another object of this invention is to mitigate the effects of extraction zone upset on processing operations associated with the extraction zone.

Yet another object of the invention is to reduce loss of solvent, which results from upset conditions.

Another object of this invention is to mitigate the effects of downstream processing unit upset on the extraction zone.

In a broad embodiment, the invention comprises passing a charge mixture stream into an extraction zone at a rate of flow subject to variation as described below; controlling the rate at which a solvent stream is supplied to said extraction zone at a previously established constant value; establishing an interface at a previously determined location in the extraction zone between a heavy phase which occupies a lower portion of the extraction zone and a light phase which occupies an upper portion of the extraction zone; varying the rate at which a stream of said heavy phase is withdrawn from said extraction zone lower portion in order to maintain said interface at a previously determined location; withdrawing a stream of said light phase from said extraction zone upper portion and dividing said light phase stream into first and second portions; establishing a recycle stream which consists of said first portion of said light phase stream and continuously supplying said recycle stream to the extraction zone at substantially the same location at which the charge mixture stream is supplied; varying the rate of flow of said recycle stream in order to maintain volumetric inventory of the extraction zone at a constant value; maintaining a combined rate of flow into the extraction zone at a previously determined constant value, which combined rate of flow consists of the sum of the flow rates of said recycle stream and said charge mixture stream, thereby causing said charge mixture stream flow rate to vary inversely with said recycle stream flow rate; and, controlling the rate of flow of said portion of said light phase stream, which remains after establishment of the recycle stream, at a previously determined constant value.

INFORMATION DISCLOSURE

Perry's *Chemcial Engineers' Handbook*, fourth editin, McGraw-Hill, may be consulted for background information on extraction, in particular, page 14 -40 and following. On page 14-43 of this reference, it is stated that reflux may be supplied to either or both ends of an extraction system in order to increase the degree of separation. Extract reflux is defined as a portion of the extract layer from which solvent has been wholly or partly removed, and raffinate reflux is a fraction of the raffinate layer which is mixed with incoming solvent. Reflux density must be different than that of either layer. The recycle stream of the present invention is not reflux; it does not serve the same purpose as reflux or have the same composition as reflux.

U.S. Pat. No. 3,435,087 (Broughton) teaches the return of a portion of the light phase withdrawn from an extraction zone in order to deal with a particular problem not addressed by the present invention. This problem is that when aromatics are separated from nonaromatics using a sulfolane-type solvent, a charge stock aromatics concentration above about 75% by weight may be miscible with the solvent phase (see column 3 of the patent). The present invention deals with a totally different problem and the recycle of the present invention is but one element of the invention.

Extraction columns often do not perform efficiently when operated at feed rates considerably less than the design feed rate for a particular column because the column internals cannot provide adequate contacting of substances at such low rates. This hydraulic problem can be solved by making physical changes in the column or by returning a portion of a product stream, as discussed in column 1 of U.S. Pat. No. 4,201,626 (Asdigian). Returning the stream performs the same function as increasing the feed rate, i.e., the hydraullic load on column internals is increased to bring it within the efficient range of the internals.

U.S. Pat. No. 3,433,735 (Broughton) may be consulted for the definition of a sulfolane-type compound, which compound is utilized in the detailed example presented herein. This patent and U.S. Pat. Nos. 3,642,614 (Van Tassell) and 3,684,245 (Van Tassell) may be consulted for further information and background on an extraction process such as that of said detailed example, to which the present invention is applicable. U.S. Pat. No. 3,037,062 (Gerhold) provides a further example of an extraction process in which the present invention may be utilized.

BRIEF DESCRIPTION OF THE DRAWINGS

FIG. 3 shows whether any mixture of aromatics, nonaromatics, and sulfolane will exist in one or two phases.

DETAILED DESCRIPTION OF THE INVENTION

Figure 1:
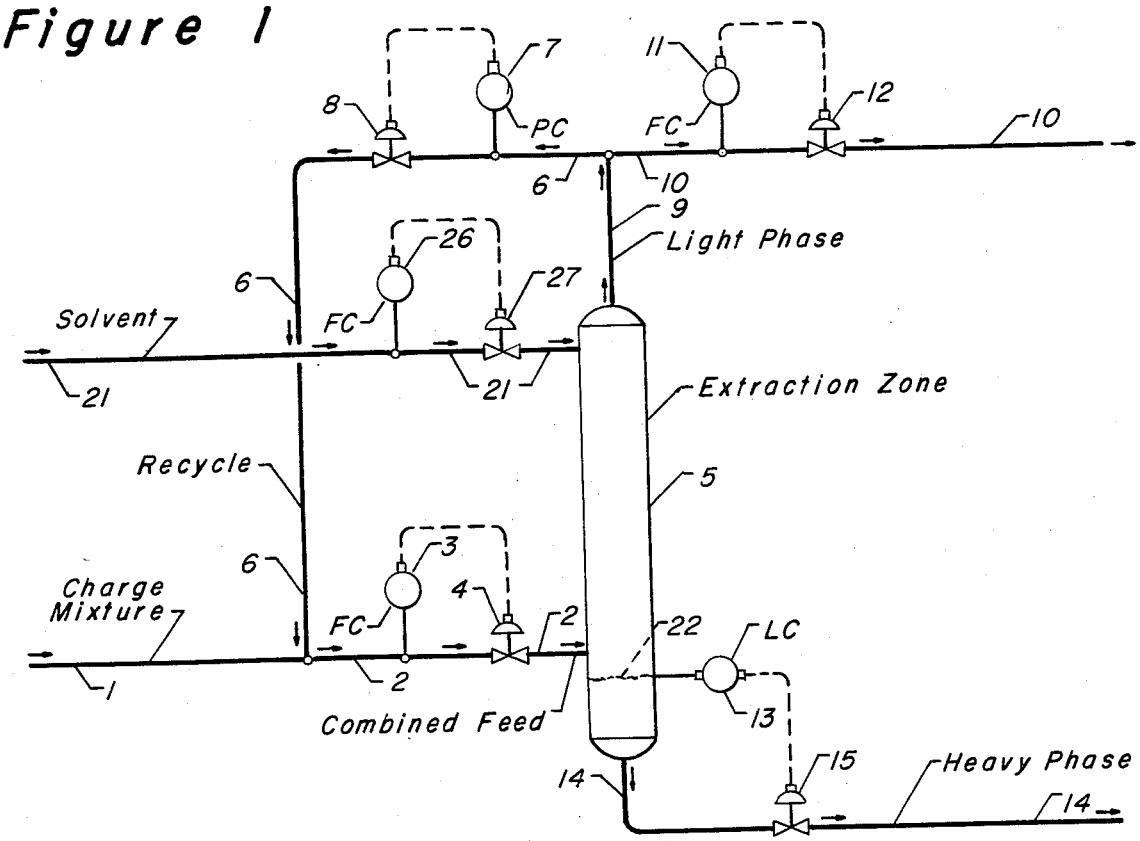
FIG. 1 is a schematic representation of a continuous countercurrent extraction zone and an arrangement of equipment used in the practice of one embodiment of the invention.
Figure 2:
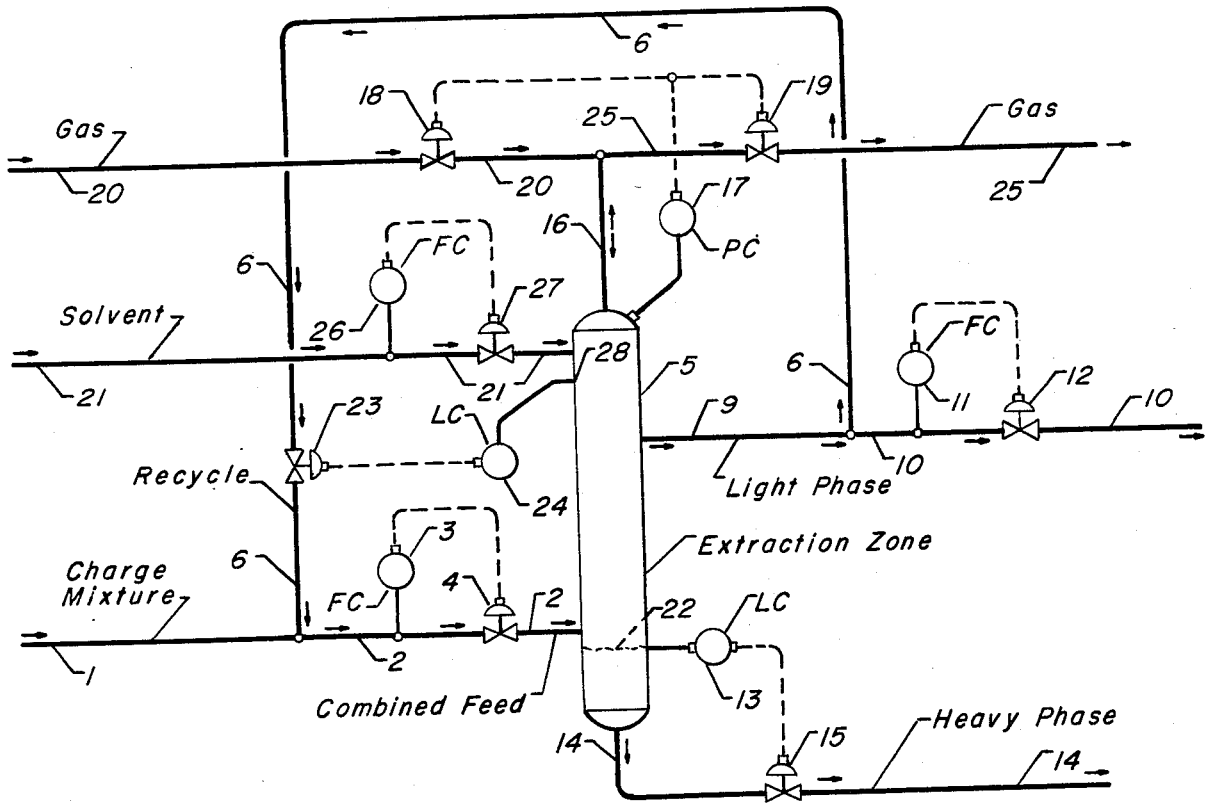
FIG. 2 is a schematic representation of a continuous countercurrent extraction zone and an arrangement of equipment used in practicing an embodiment of the invention. The lower portion of FIG. 2 is identical to the lower portion of FIG. 1, while the portion of FIG. 2 shows a preferred arrangement which is unlike FIG. 1.

A detailed example will now be utilized as a vehicle to explain the invention. The use of this example is not intended to constitute an undue limitation on the broad scope of the invention as set forth in claims. FIGS. 1 and 2, which will be used in explaining the detailed example, represent only particular embodiments of the invention and are not intended to limit the scope of the invention. FIGS. 1 and 2 depict only items that are useful in the description of the process; certain items such as pumps, heat exchangers, surge drums, etc. have been omitted as not essential to a clear understanding of the process, the use of such hardware being well within the purview of one skilled in the art. The composition values used are not meant to be representative of commercial products, but were arbitrarily chosen.

As will become apparent, it is desirable to maintain a constant composition profile in an extraction zone. In the detailed example, the composition profile may be viewed as a composite of two profiles, an aromatic profile and a nonaromatic profile. It is convenient to visualize, for example, the aromatic profile as a plot of location in the zone versus aromatics concentration, with location on the vertical axis. When shifting of the aromatic profile in the zone is considered, one can visualize the curve shifting up or down in relation to the vertical axis.

The present invention is directed toward maintaining a constant composition profile by changing combined feed composition to compensate for process fluctuations. Prior art methods of operation have not recognized that changing feed composition will prevent and/or dampen composition fluctuations in the zone.

In this detailed example, a charge mixture stream comprising two substances, aromatic hydrocarbons and nonaromatic hydrocarbons, is supplied to an extraction zone in order to separate the two substances. The desired product streams from the extraction zone need not be totally free of one substance. Thus, in this example, the aromatic hydrocarbon product stream will also contain some nonaromatics and the nonaromatic product stream will also contain some aromatics. Referring to FIG. 1, the charge mixture stream is supplied to extraction zone 5 by means of pipelines 1 and 2. A recycle stream in pipeline 6 is combined with the charge mixture stream in pipeline 1 to form a combined feed stream to the extraction zone in pipeline 2. The recycle component of the combined feed stream in pipeline 2 will be exlained hereinafter. The rate of flow of the combined feed stream, which is the sum of the flow rates of the recycle stream and the charge mixture stream, is controlled at a previously established constant value. This constant value is entered into flow controller 3, which measures the rate of flow in pipeline 2 and provides a signal to control valve 4, which changes position in response to the signal in order to maintain a constant flow rate. The dotted line between flow controller 3 and control valve 4 represents transmission of the control signal. These items and the operation of the flow control loop comprised of these items are well known to those skilled in the art.

A solvent is supplied to extraction zone 5 by means of pipeline 21. Flow rate of solvent is controlled at a previously established constant value by means of a flow control loop comprised of flow controller 26 and control valve 27, which operate in the same manner as those of the combined feed flow loop. A preferred solvent for accomplishing the separation of this example is a sulfolane-type compound. Solvents for this application may also comprise glycol compounds of various types. Continuous countercurrent extraction takes place in extraction zone 5. The specific gravity of the combined feedstream is less than that of the solvent stream. Thus the combined feedstream flows upward in extraction zone 5, or the extraction column, and the solvent stream flows downward in the extraction column. In this example, the solvent is dispersed in the combined feedstream, which may be referred to as the continuous phase after it enters the zone. The compositions of both streams continuously change as the streams travel through the extraction zone and therefore, after injection of the charge mixture stream and solvent stream into the extraction zone, different nomenclature is used. Light phase, or light phase stream, refers to the upward moving material and to material leaving the zone at the top, and heavy phase, or heavy phase stream, refers to the downward moving material and to material leaving the zone at the bottom. The terms are also used by those skilled in the art to differentiate liquid above the interface (described below) from liquid below the interface; light phase is that above and heavy phase is that below the interface. Of course, heavy phase is normally moving through the light phase and/or light phase is moving through the heavy phase.

Figure 4:
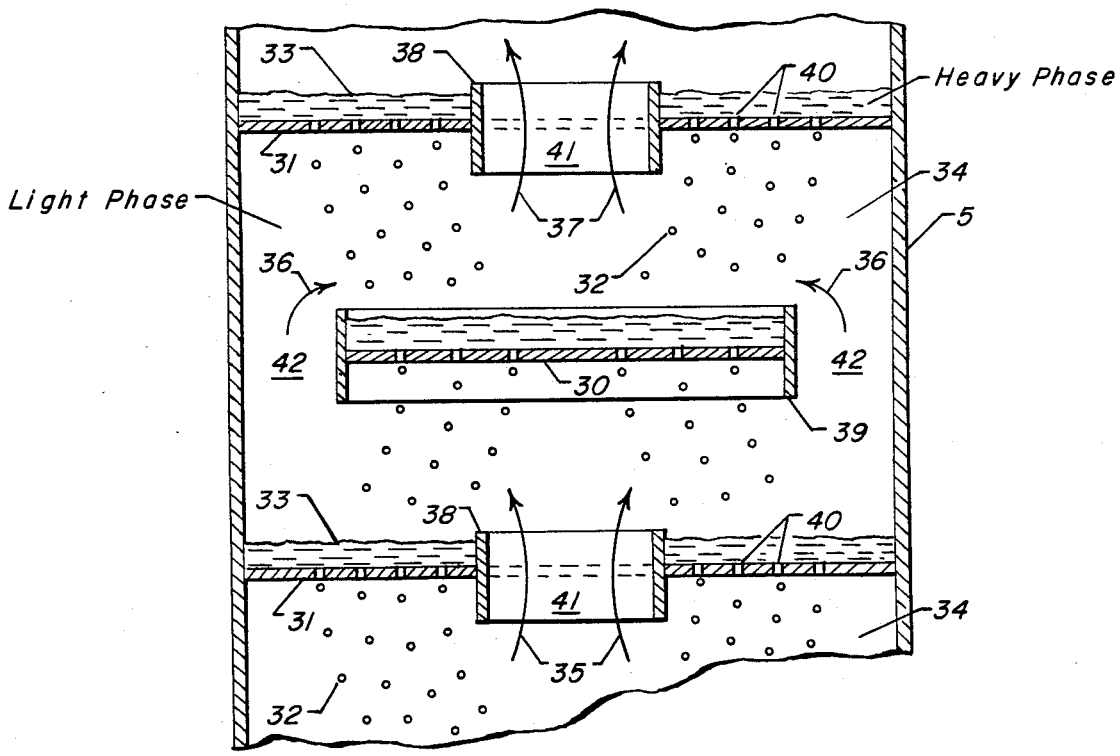
FIG. 4 is a schematic representation of a portion of an extraction zone showing one type of zone internals and the flow of light and heavy phases through the zone.

Referring now to FIG. 4, a portion of extraction zone 5 is depicted. The internals of this extraction column comprise a series of trays 30 and 31. Each tray is flat and horizontal and contains a multiplicity of perforations, or small holes, such as hole 40, the holes having a diameter dependent upon such design factors as flow rates, specific gravities, etc. In a typical extraction column utilized in the process of this example, the diameter range may be about 3 to 8 millimeters. All of the free space within the column shown in FIG. 4 is filled with light phase 34. Droplets of the heavy phase are dispersed throughout light phase 34, as depicted by representative droplets 32. It should be noted that FIG. 4 is a schematic representation and the trays will actually have considerably more holes than shown. Each of the trays 31 has a passage 41 in the center of the tray to permit light phase to flow upward. Each of the trays 30 has two annular segments removed to provide two passages 42 for the upward flow of the light phase stream, one on either side of the circular tray. Arrows 35, 36, and 37 depict the flow path of the light phase.

Substantially all of the heavy phase flowing downward through the column is collected on each tray and then flows through the holes of each tray, forming droplets as it exists from each hole. There must be an inventory, or a level, of heavy phase on each tray in order that there be downward flow through the holes, i.e., a head of liquid is required to overcome resistance to flow through the holes. Reference number 33 denotes such liquid on a tray. In order to retain the tray inventory, each tray has walls, or weirs, 38 and 39. Without weirs 38 and 39, heavy phase would flow downward around the edges of the openings in the trays. Under normals operating conditions, substantially all of the heavy phase passes through the perforations in the trays and substantially all of the light phase passes through the passage 41 and 42, which are also called upcomers. This type of extraction zone internal design is well known to those skilled in the art. Note that there are numerous other types of internals which may be used.

An interface, denoted by reference number 22, is formed in the extraction zone at a point below the entry point of the combined feedstream and is located at the point at which level controller 13 is shown attached to extraction zone 5. Heavy phase liquid occupies a lower portion of the extraction zone below the interface. The light phase occupies an upper portion of the extraction zone above the interface; however, some of the heavy phase liquid is also dispersed throughout the light phase, as described herein.

The impure products of the liquid-liquid extraction process of this example are withdrawn from extraction zone 5 by means of pipelines 9 and 14, which carry a light phase stream and a heavy phase stream respectively. The heavy phase stream contains a larger amount of solvent that the light phase stream and further contains a larger amount of one of the substances of the charge mixture stream, in this case, aromatic hydrocabons. The light phase stream comprises a small amount of solvent, a small amount of the first component of the charge mixture stream, in this case aromatic hydrocarbons, and a larger amount of the second component of the charge mixture stream, in this case, nonaromatic hydrocarbons. The light phase stream is subjected to further processing in downstream equipment to remove solvent from impure extraction zone product which comprises primarily nonaromatic hydrocarbons. The heavy phase is also subjected to further processing in that portion of the extraction unit downstream from the zone to separate solvent an impure extraction zone product which is comprised of more aromatic hydrocarbons than nonaromatics. Solvent from the separation processes is reused in the extraction zone. Methods of processing of the impure product streams withdrawn from the extraction zone may be seen in the patents cited above under the heading "Information Disclosure".

The terms extract and raffinate are commonly used when dealing with extraction processes. Extract refers to the phase which contains the larger amount of solvent; usually the extract stream is comprised principally of solvent. Raffinate refers to the stream which has been treated by the solvent. In this example, the light phase is raffinate and the heavy phase is extract.

In this detailed example, the heavy phase is dispersed in the light phase. In other examples, the heavy phase may be continuous, with the light phase being dispersed. Solvent may be either the heavy phase or the light phase. The location of the interface may vary, in accordance with several factors, certain of which are apparent from the pages of the *Chemical Engineers' Handbook* cited above under the heading "Information Disclosure". The present invention is applicable to extraction zones whose internal arrangement is different from the detailed example presented herein.

Referring again to FIG. 1, the rate at which heavy phase is withdrawn from the lower portion of extraction zone 5 via pipeline 14 is controlled by the location of the interface between the light and heavy phases. Level controller 13 senses interface position and adjusts control valve 15 to maintain interface position at a previously determined location. For example, if the interface level rises, control valve 15 will open to increase the flow rate of heavy phase out of the column and thereby lower the interface level. The light phase stream flows out of extraction zone 5 via pipeline 9.

FIG. 1 depicts four streams entering and leaving the extraction zone. In an extraction of the type described in this detailed example, a fifth stream is normally also provided to the extraction zone. This fifth stream (not shown) is denoted a reflux stream, which is a fraction of the heavy phase stream removed from the column. Initial processing of the heavy phase stream in downstream equipment after removal from the zone results in two separate streams, one comprising primarily light aromatic and nonaromatic hydrocarbons and one comprising primarily solvent and aromatics. At least a portion of the former stream is returned to the extraction zone as reflux, while the latter is subjected to further processing. The reflux stream is preferentially soluble in the solvent and as it rises in the extractor it displaces heavier nonaromatic hydrocarbon from the dispersed droplets of solvent which are falling through the hydrocarbon phase. Thus, the nonaromatic content of the heavy phase is biased in favor of light nonaromatics, which are easier to remove in downstream equipment than heavy nonaromatics. In general, the sulfolane-type solvent used in this detailed example prefers aromatics over nonaromatics and light hydrocarbons over heavy hydrocarbons. Additional information on such reflux streams is available in U.S. Pat. No. 3,433,735 (Broughton), cited above.

Liquid-liquid extraction columns, such as a column for separation of hydrocarbons in accordance with the present detailed example, are quite sensitive to fluctuations in flow rate and composition of any of the streams associated with the column. Sudden changes in any one of these parameters, even transient changes which exist for only a short time before an affected parameter returns to its normal value, cause changes in the other parameters. It is obvious that it is undesirable for a product flow rate to decrease or a product composition to vary from the desired composition. When a product composition is outside an acceptable range, the product is often returned to a feed tank for the extraction unit, thus causing a 100% loss of production. Further, fluctuations in certain streams cause problems in other processing units. For example, a fluctuation in heavy phase composition may cause difficulty in operating the downstream equipment which separates the heavy phase into a light aromatic and nonaromatic fraction and a solvent plus aromatic-fraction. Further, such difficulty could affect composition of a reflux stream of light aromatics and nonaromatics returned to the extraction zone and thereby further affect the extraction zone. It can be appreciated that a single minor fluctuation can result in major problems as it is magnified and propagated throughout the entire processing unit, consisting of the extraction zone and the downstream equipment which further processes product streams from the zone.

In order to operate an extraction zone in as stable a manner as possible, the normal procedure is to control the flow rates of both the charge mixture stream and the solvent stream to the zone. The position of the interface between the heavy phase and the light phase is sensed and the flow of heavy phase out of the zone is adjusted in order to maintain the interface in its normal position, in the same manner as described above in connection with FIG. 1. If a reflux stream is supplied to the extraction zone, it also is flow controlled, either directly or indirectly. Since the extraction zone is full of incompressible liquid, the one remaining of the streams flowing to and from the zone cannot be flow-controlled. It may be provided with a pressure control loop such as is shown in FIG. 1 or a liquid level control loop as shown in FIG. 2, both of which will be described below. In any case, in a typical prior art system the flow of light phase stream out of the column is throttled to maintain the volumetric inventory of liquid in the column. This flow must be permitted to vary to accommodate variations in flow of the other streams supplied to and removed from the column and it is often referred to as an "uncontrolled" flow, or variable, even though it is regulated by inventory-maintaining apparatus such as shown in FIGS. 1 and 2. Composition of the solvent stream is partially controlled, since solvent is normally purified in downstream equipment prior to being reused. But solvent composition is subject to fluctuations in the downstream equipment as well as to extraction zone fluctuations.

In a typical extraction unit, a secondary level of control is provided, which consists of monitoring of compositions of certain streams, and adjusting the set points, or previously established constant values, of the flow control loops, which flow loops may be denoted as the primary level of control. Another element of the secondary level of control may consist of monitoring and keeping constant the ratio of solvent flow to charge mixture flow. A major problem with this secondary level of control is that by the time variations in composition are detected, they are significant enough to cause further problems or the further problems have started to occur. Thus, the normal control philosphy for an extraction column may be summarized as maintaining constant flow rates and adjusting them as compositions change. As discussed herein, compositions are continuously changing, within a range whose span is determined by the quantity and quality of the corrective adjustments. The system, that is, its operating point, is continually moving, or rocking back and forth.

It is the opinion of many skilled in the art that the above-described primary-level control scheme provides the most stable method of operation of an extraction column. The problem with this control scheme is that no provision is made for taking action to minimize the effects of a fluctuation other than to return flows to their previous constant values. This may be described as simply waiting for the problem to work itself out of the system. While waiting for correction of the upset, extraction unit products are often recycled back to an extraction unit feed tank, as mentioned above, and there is 100% loss of production. If an upset condition persists, the entire extraction unit may be shut down and operations restarted from the beginning, though this is not a usual expedient. As mentioned above, there are certain adjustments which a human operator may make in an attempt to shorten the time period during which off-specification product is produced. For example, reflux rate to the bottom of the column (if reflux is used) may be temporarily increased or the charge mixture flow rate may be temporarily decreased. But, even with measures such as this, the production loss is usually significant. A further problem with prior art methods of operation is that product purities tend to be maintained at values higher than actually required, in order to provide a margin for error; this procedure reduces production rates and increases operating costs.

In a unit such as that of the detailed example, replacement of a valve positioner on the control valve in the heavy pahse stream pipeline from the extractor caused an upset of such magnitude that 24 hours of production was lost. Another common example of a fluctuation which causes an upset of extraction zone operation and significant loss of production is a change in feed composition. In the detailed example, the charge mixture stream is a product stream from a hydrocarbon reforming process. If the operating conditions of the hydrocarbon reforming process vary or are changed such that the reforming product composition is changed, as is frequently the case, there will be an upset in the extraction zone. On certain occasions, it is desired to provide a liquid-liquid extraction system of this example with a charge mixture stream having a composition such that the problems of instability are magnified to the point where normal fluctuations cause sufficient upsets that very little on-specification product can be produced between upsets.

The present invention provides methods of operation and control systems for a solvent extraction zone which minimize the effects of flow and composition fluctuations, so that product purities are maintained at specified values. The invention provides a specific response to many types of fluctuations, which response acts to mitigate the effects of the fluctuation, rather than to simply limit the fluctuation without taking action to counteract it. When a charge mixture stream having a different composition is provided to an extraction zone, the operation of the zone and the downstream equipment comprising the extraction unit must change to accommodate the new composition. Practice of the invention provides a method of accommodation, whereas the prior art control scheme described above does not. Ideally, when using a prior art control scheme, the change mixture composition would be changed sufficiently slowly that the extraction zone would not be upset, but a slow change is often not possible.

In the practice of the invention, a recycle stream is established which consists of a portion of the light phase stream. Referring to FIG. 1, the light phase stream flowing out of extraction zone 5 in pipeline 9 is divided into a first portion, which flows in pipeline 6, and a second portion, which flows by means of pipeline 10 to downstream equipment for further processing steps for removal of solvent from nonaromatic product. The flow rate of the second portion of light phase is maintained at a previously determined constant value by means of a flow loop comprised of flow controller 11 and control valve 12, which flow loop is conventional and functions in the same manner as those described above. The recycle stream of the present invention flows through pipeline 6 and is combined with the charge mixture stream flowing in pipeline 1 to form a combined feed stream to the extraction zone, which combined feedstream is conducted to the zone pipeline 2. Pressure controller 7 senses the pressure in pipeline 6 and provides a signal to control valve 8 such that control valve 8 maintains a previously determined pressure. This pressure control loop operates in a conventional manner. The pressure sensed in line 6 is equivalent to the pressure in the top portion of extraction zone 5; if desired, pressure controller 7 can be connected directly to the extraction zone. The pressure in line 6 or the extraction zone simply serves as a convenient indicium of the inventory of the extraction zone, i.e., the volume of the extraction zone is constant, the zone is filled with liquid, and the volumetric difference between streams entering the zone and other streams leaving the zone is accommodated by this control loop.

As described above, in the usual prior art control method, the light phase stream withdrawn from the zone is not divided, but is provided in total to downstream equipment for further processing, and control of the stream is provided by a pressure control loop or its equivalent, as described above.

The flow rate of the combined feed stream in pipeline 2 is maintained at a previously determined constant value by flow controller 3 and control valve 4. As previously mentioned, the combined feed stream consists of the charge mixture stream and the recycle stream, thus the sum of the flow rates of these two streams is held at a constant value. The system is arranged so that recycle flow has preference over charge mixture flow, that is, all of the recycle flow will become a part of the combined feed stream and the rate of flow of the charge mixture stream will vary inversely with the recycle flow. Under normal stable operating conditions, recycle liquid will comprise flow from about 1% to about 60% of the combined feed stream, with a preferred recycle flow being in a range of about 10 to 40% of the combined feed stream. It is advantageous to minimize the flow rate of the recycle stream in order to maximize extraction zone capacity; however, there must be a sufficient recycle flow to allow the recycle flow to change and correct an upset which requires a decrease in recycle flow. Too little recycle flow will result in the invention being effective only a portion of the time. When an upset occurs, the recycle flow may drop to 0 for a short time or may increase to near 100% of the combined feed stream for a short time.

It is to be noted that this control action is totally opposite to conventional ideas of control of an extraction zone. The normal practice is to control charge mixture flow rate at a constant value and hope that charge mixture composition will not fluctuate. Here the charge mixture flow rate is varied and the composition of the combined feed stream will vary widely, as the recycle flow varies.

The control scheme depicted in FIG. 2 accomplishes the same results as that of the corresponding portion of FIG. 1. A quantity of inert gas is maintained within the uppermost portion of extraction zone 5. This gas takes no part in the separation and serves to establish a liquid level in the uppermost portion of the column. In the present detailed example, the use of inert gas prevents vaporization of light hydrocarbon fractions, since such use permits the column to be operated at above atmospheric pressure. The liquid level serves as an indicium of the inventory of the extraction zone in the same manner that the pressure measured by pressure controller 7 of FIG. 1 serves as such an indicium. Gas enters the column through pipelines 20 and 16. Pressure controller 17 adjusts control valve 18 such that when the pressure in the column is low, gas is allowed to flow, or flow at an increased rate, through valve 18 into the zone. If pressure rises above a previously established constant value, gas flows out of zone 5 via pipelines 16 and 25, with control valve 19 opening to permit such flow in response to a signal from pressure controller 17. The location of the level of light phase in the zone is denoted by reference number 28. The light phase stream must be withdrawn from the zone via pipeline 9 at a point below this level; otherwise, the description of pipelines 9, 6, and 10 and flow controller 11 and control valve 12 is identical to that presented for FIG. 1. Level controller 24 adjusts the position of control valve 23 in order to vary the flow rate of the recycle stream in piepline 6. If the inventory of zone 5 increases, causing an increase in level sensed by level controller 24, recycle flow increases in order to lower the level. The use of inert gas as depicted in FIG. 2 is preferred, since control of pressure of a zone filled with liquid in the manner shown in FIG. 1 may result in excessive variation in recycle flow or other undesirable effects.

Figure 3:
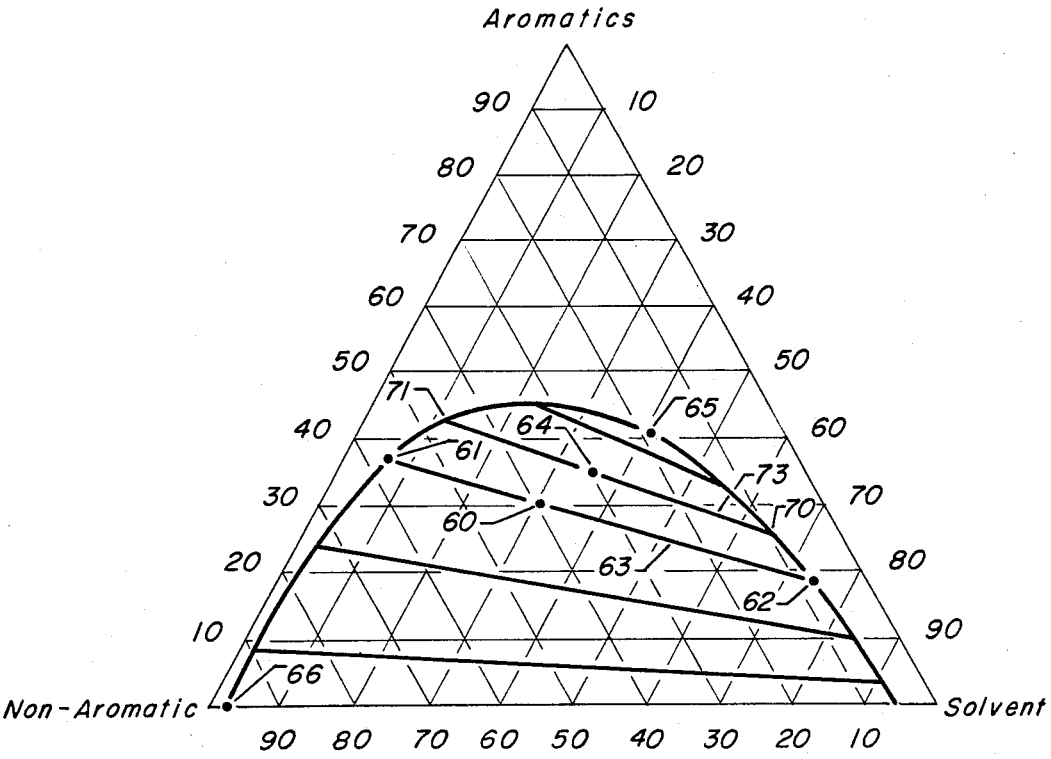
FIG. 3 is a ternary diagram for a sulfolane-type solvent and a hydrocarbon mixture comprising aromatics and nonaromatics. The aromatics are primarily benzene, toluene, and xylene. As is known to those familiar with extraction processes.

The continuous countercurrent extraction process taking place in extraction zone 5 may be viewed as a series of numerous individual extraction steps, where each step involves contacting a light phase and a heavy phase and then separating the phases. Each phase leaves each step having a slightly different composition than it did when entering the step. There are methods for calculating the results of such a series of steps which are familiar to those in the art, but they need not be explained herein, as they are not necessary to an understanding of the invention. However, the data displayed by means of FIG. 3, which is a ternary diagram, will be useful. The numbers along the edges of the triangle of FIG. 3 are percentages The portion of the diagram which is under the curve represents a region of composition where liquid having that composition will separate into two phases. Liquid having a composition represented by the portion of the diagram not under the curve will not separate into phases. As composition of a two-phase liquid approaches the single phase region, that is, approaches the curve from within, the densities of the two phases converge toward the same value and it becomes increasingly difficult to detect an interface between the two phases.

Referring to FIG. 3, the point marked by reference number 60 is 40% nonaromatics, 30% aromatic, and 30% sulfolane. If a hydrocarbon mixture consisting of 40 lbs. of nonaromatic hydrocarbons and 30 lbs. of aromatic hydrocarbons, for a total of 70 lbs. of mixture, is mixed with 30 lbs. of solvent, the resulting mixture is represented on FIG. 3 by point 60. Upon settling after thorough mixing, the compositions of the resultant two phases may be determined by following tie line 63 to points 61 and 62. The compositions of the two phases as represented by points 61 and 62 are as follows;

| | Light Phase | Heavy Phase |
|---|---|---|
| Aromatics | 37 | 18 |
| Solvent | 7 | 74 |
| Nonaromatics | 56 | 8 |

FIGS. 1, 2, and 3 may be used to illustrate a common problem and operation of the invention. Using the detailed example, assume that flow of reflux (not shown) to the extraction column of FIG. 1 or 2 is adjusted. This adjustment is made because product purity has drifted away from the required value. Assume that point 60 of FIG. 3 represents the contents of the entire extraction zone before the adjustment. When the reflux rate is increased, there is an increase in the flow of light phase up the column. This light phase flow increase may be explained by reference to a variety of factors, though the particular reasons for the flow increase are not relevant to the practice of the invention. One factor is that upon introduction to the column, the reflux stream, which is comprised of light aromatics and nonaromatics, partitions such that a portion of the flow increment moves upward and a portion moves downward. The upward moving portion is larger than the downward moving portion, thus the net result is an increase in upward flow. This tends to expand the aromatics profile of the extraction zone upward, thereby displacing light phase and causing an increase in light phase flow out of the zone. In the exemplary process, as a result of the method by which reflux flow is increased, the reflux contains a higher percentage of aromatics after its flow rate is increased. This tends to increase the light phase stream flow even further.

Another factor to be considered is the selectivity of the solvent. As mentioned above, reflux displaces nonaromatics, which leave the zone in the light phase. Note that this is precisely the reason for making the reflux adjustment, that is, to increase the concentration of aromatics in the heavy phase. It can be seen that incrementally driving nonaromatics toward the top of the zone causes an increase in flow of light phase out of the zone and a decrease in nonaromatics in the zone.

Since the aromatics profile has shifted upward in the zone, that is, nonaromatics concentration has decreased, the point which represents total extraction zone contents on FIG. 3 will shift toward higher aromatics concentration and higher solvent concentration. Point 64 represents such a new system composition. The total composition is now about 35% aromatics, 35% solvent and 30% nonaromatics. Using tie line 73 to obtain the composition of each phase, represented by points 70 and 71, yields the following:

| | Light Phase | Heavy Phase |
|---|---|---|
| Aromatics | 43 | 26 |
| Solvent | 12 | 65 |
| Nonaromatics | 45 | 9 |

If points 61 and 62 represent the desired impure extraction zone product specifications, it can be appreciated that the change to compositions of points 70 and 71 is undesirable.

It can be seen that there is more solvent in the column by referring to the above figures: 35% solvent instead of 30%. This is called "stacking"—solvent "stacks up" in the extraction zone. Stacking may be defined as an increase in inventory of solvent in the zone.

The initial increase in reflux flow caused the extraction zone operating point to change from point 60 to point 64. An additional increase in light phase flow which results from the prior art controls causes the operating point to drift toward point 65. The control system for the extraction zone tends to move the operating point away from point 60, which represents the desired product specification, rather than toward it.

When the operating point of the extraction zone moved from point 60 (FIG. 3), an increasing part of the solvent and of the aromatics entering the extraction zone began to enter the light phase. This can be seen by comparing the light phase composition at point 60 with the light phase composition at point 64. The concentrations of both solvent and aromatics in the light phase are larger at point 64. This increased amount of solvent and aromatics can only come from the heavy phase. Thus the interface level in the zone must drop. The level controller and control valve at the bottom of the zone must will then restrict the flow of heavy phase out of the column in order to return the interface level to its proper value. Therefore, flow of light phase out of the column through pipeline 9 must increase, since the flow into the column must equal the flow out of the column and one outflow has been reduced. An increase in light phase stream flow causes the operating point to move from point 64 toward point 65. Without the recycle flow of the invention, this further flow increase only aggravates the situation. The operating point does not stabilize, but continues to move in the wrong direction.

Note that when the aromatic profile moves upward, downcoming droplets of dispersed (heavy) phase at any particular point in the zone are in contact with light phase having a lesser concentration of nonaromatics at that point, as compared to the concentration before the increase in reflux flow was made. Therefore, the dispersed (heavy) phase becomes more aromatic (increases in aromatic concentration). The reflux fractionated from this more aromatic heavy phase also becomes more aromatic. Thus the aromatic profile shifts upward and continues shifting upward as the cycle continues, causing the operation point of the system to drift toward point 65 (FIG. 3).

Though the conventional control scheme would appear to offer maximum stability, it is seen that it cannot deal effectively with this upset. The upset gets worse instead of better and is propagated throughout the whole extraction unit and then the extraction zone is further adversely affected by changes in reflux and solvent to the zone caused by such propagation. A control system which will act to prevent or stop the above-mentioned shift in aromatics profile is required. Maximum stability of the extraction zone requires that the composition profile of the zone not shift.

Consider now the effect of the control system of the present invention. When the flow of heavy phase is decreased by level controller 13 in order to maintain the proper interface level, the flow of light phase via pipeline 10 to downstream equipment for further processing will remain constant and therefore not propagate the upset into that equipment. This is a significant advantage of the invention. Since the flow out of the top of the extraction zone must increase, it will be recycle flow which increases. This is accomplished by pressure controller 7 and control valve 8 of FIG. 1 as described above, by the controls depicted in FIG. 2 (described above), or by other appropriate means. Since the recycle flow is combined with the charge mixture, the combined feed stream rate to extraction zone 5 will not change and thus there will be no ripple effect, that is, no change in flow which will cause additional upset. Since an increase in recycle flow rate results in a decrease in charge mixture flow rate, the combined feed to the column will contain a lesser amount of aromatics. Therefore, it would seem that the upward flow rate in the zone would either remain the same or increase, thus aggravating the problem of increased solvent inventory on the trays, or stacking. Further, it would be expected that a lesser quantity of aromatic entering the column would cause an additional decrease in heavy phase flow out of the zone. However, this is not the case. The light phase recycle stream causes the aromatics profile, which has shifted upward, as previously explained, to shift downward toward its original position, i.e., the total composition profile moves back toward point 60. The initial causative fluctuation and prior art control system action results in the extraction zone being depleted in light phase. The practice of the invention prevents such depletion by returning any increase in light phase flow to the zone. As solvent which is accumulated in extraction zone is replaced by light phase, there is an increased flow of heavy phase downward, a resultant increase in interface level, and thus an increase in flow rate of the heavy phase stream. As the outflow via the heavy phase stream increases, the recycle flow must decrease. This will be accomplished (if the FIG. 2 scheme is used) by control valve 23 closing in response to falling level sensed by level controller 24. In this manner, the method of operation of the invention dampens the fluctuations.

It should be noted that the above detailed description of liquid movement in the extraction zone is presented to aid in an understanding of the invention and is not meant to exclude other mechanisms which exist within the zone or to limit the scope of the method of operation claimed. Also, those skilled in the art will appreciate that the description utilizing the ternary diagram is simplified in order to help in understanding the invention.

A purpose of the increase in reflux flow is to effect a small change in light phase stream flow out of the zone. The prior art method of operation described herein causes light phase to be removed from the extraction zone upon a change in reflux in ever-increasing amounts, as described above. There is no reason to remove light phase beyond an initial flow increment and the practice of the invention prevents such removal. Continued removal of light phase causes a change in the composition profile within the extraction zone beyond the change required. It can be appreciated that maintaining a constant composition profile in the extraction zone will result in the streams flowing out of the zone having an on-specification composition.

Consider the effect of a change in charge mixture composition. This might be caused by operating the reforming process (mentioned above) at an increased severity in order to increase the amount of aromatics in the charge mixture stream. An increased combined feed aromatics concentration will cause the aromatics profile in the extraction zone to shift upward. This will cause the same events described above to take place. The upward shift of the aromatics profile will cause the system composition to move away from point 60 of FIG. 3 and the practice of the invention will tend to return the system to point 60. It should be noted though, that in this case, where there is a change in charge mixture composition which remains in effect for a period of time, rather than a fluctuation, there must be a corresponding change in extraction zone operation, that is, the operating point must move to a new location consonant with the new charge mixture concentration. This is accomplished by an operator and may comprise, for example, a change in solvent/heavy phase ratio (described below).

It is instructive to consider an explanation which is advanced by a portion of those individuals skilled in the art, which explanation deals with stacking and which may be expanded to one of several theories on the mechanism of the invention. Again, assume that a fluctuation is caused by adjusting flow of reflux (not shown) to the extraction column of FIG. 1 or 2. This adjustment is made because product purity has drifted away from the required value. Assume that point 60 represents the contents of the entire extraction zone. If the reflux rate is increased, there is an increase in the flow of light phase up the column (as discussed above). Now referring to FIG. 4, it can be seen that an increase in the flow rate of light phase, and therefore in the upward velocity of the continuous phase, will effect the flow of droplets of heavy phase. Some droplets of heavy phase will be swept upward through the upcomers 41 nd 42. These droplets will be deposited on the trays 30 and 31 and increase the inventory of heavy phase on the trays. Since fewer droplets of the heavy phase are moving downward in the column the interface level will drop. The level controller and control valve at the bottom of the zone will then restrict the flow of heavy phase out of the column in order to return the interface level to its proper value. Therefore, flow of light phase out of the column through pipeline 9 must increase, since the flow into the column must equal the flow out of the column. Without the recycle flow of the invention, this further flow increase only aggravates the situation, as can be seen by referring to FIG. 3. The initial increase in reflux flow caused the extraction zone operating point to change from point 60 to point 64. The additional increase in light phase flow which results from the prior art controls causes the operating point to drift toward point 65. Any departure from the chosen point of operation (in this example point 60) results in off-specification product. The control system for the extraction zone tends to move the operating point away from the point 60 rather than toward it. Though the conventional control scheme would appear to offer maximum stability, it is seen that cannot deal effectively with this upset.

Consider now the effect of the control system of the present invention. When the flow of heavy phase is decreased by level controller 13 in order to maintain the proper interface level, the flow of light phase via pipeline 10 to downstream equipment for further processing will remain constant and therefore not propagate the upset into that equipment. This is a significant advantage of the invention. Since the flow out of the top of the extraction zone must increase, it will be recycle flow which increases. This is accomplished by pressure controller 7 and control valve 8 of FIG. 1 as described above, by the controls depicted in FIG. 2, or by other appropriate means. Since the recycle flow is combined with the charge mixture, the combined feed stream rate to extraction zone 5 will not change and thus there will be no ripple effect, that is, no change in flow which will cause additional upset. Since an increase in recycle flow rate results in a decrease in charge mixture flow rate, the combined feed to the column will contain a lesser amount of aromatics. Therefore, it would seem that the upward flow rate in the zone would either remain the same or increase, thus aggravating the problem of increased solvent inventory, or stacking. Further, it would be expected that a lesser quantity of aromatics entering the column would cause an additional decrease in heavy phase flow out of the zone. However, this is not the case. This may be seen by considering thaat the specific gravity of the feed is decreased by replacing charge stock mixture with light phase. In the column, a decrease in the specific gravity of the light phase traveling upward will result in less entrainment and less carrying-upward of heavy phase droplets. Thus the column will unstack, that is, the inventory on the trays will decrease. As more heavy phase comes down the column, as a result of unstacking, the interface will rise, causing the level control loop to increase the flow of heavy phase out of the column via pipeline 14. Then, in order to maintain the inventory within the column, light phase flow out of the column via pipeline 9, and therefore recycle flow through line 6, must decrease. This will be accomplished (if the FIG. 2 scheme is used) by control valve 23 closing in response to falling level sensed by level controller 24. As light phase flow up the column decreases due to the action of control valve 23, still fewer droplets are entrained. The operating point of the extraction zone moves back toward its proper location (point 60 of FIG. 3 in this example).

It should also be noted that it may not be initially necessary for any droplets, or any significant number of droplets, to be swept upward to the point of being deposited on trays. Any decrease in downward velocity of droplets, caused by the upward flow rate increase, may cause a drop in interface level, thereby triggering the cycle described above.

It should be noted that the above detailed description of the movement of droplets in the extraction zone is presented to aid in an understanding of the invention and is not meant to exclude other mechanisms which exist within the zone or to limit the scope of the method of operation claimed. Also, those skilled in the art will appreciate that the description utilizing the ternary diagram is simplified in order to help in understanding the invention.

Consider the effect of a change in charge mixture composition. This might be caused by operating the reforming process (mentioned above) at an increased severity in order to increase the amount of aromatics in the charge mixture stream. Providing a heavier feed to the extraction zone, that is, a feed of higher specific gravity, results in a light phase having a higher specific gravity. A heavier upward flowing liquid will entrain more of the downward flowing droplets, thus causing stacking. The control system will relieve the stacking by lowering the specific gravity of the combined feed in the same manner as described above.

In conjunction with the above-described method of operation of this invention, additional control actions may be employed. As mentioned above, these actions may be necessary to accommodate certain changes, such as the previously-described change in charge mixture composition. It is often worthwhile to monitor the solvent to extract, or heavy phase stream, ratio and maintain this ratio at a constant value, there being a particular constant value desired for each system operating point (such as point 60 of FIG. 3). Solvent stream flow rate is divided by the flow rate of heavy phase out of the bottom of the extraction zone and the set point of the solvent stream flow control loop is adjusted in response to variations in the ratio in a conventional feedback type of control. In the detailed example, a common S/E ratio is 2/1, with a common range of 1:8/1 to 3/1.

Where a reflux stream is employed, a change in composition of the product contained in the heavy phase stream may be compensated for by adjusting reflux flow ratte. The heavy phase stream product composition may be measured before the heavy phase stream from the extraction zone is subjected to further processing or it may be measured at a downstream point in the extraction unit, such as after the reflux stream is separated from the heavy phase stream. Since the heavy phase stream composition is substantially the same as that of the heavy phase in the extraction zone below the interface, composition may also be measured at that location. The flow rate of the second portion of light phase stream flowing from the extraction zone, such as that in pipeline 10 of FIGS. 1 and 2 may be linked to the composition of the reflux stream. The previously established constant value of the flow loop, that is, the set point of flow controller 11 is adjusted in response to variation in composition. Note that compositions may be measured by on-line instruments, such as chromatographic analyzers, or by means of a specific gravity apparatus to which an operator adds a sample previously withdrawn from a pipeline. Process control equipment may be used to make adjustments in response to composition changes or operators may make such adjustments.

In an embodiment of the invention different from those discussed above, a composition measurement is used to adjust recycle flow. This embodiment, which may be less preferable than those discussed above, may be summarized as passing a charge mixture stream into an extraction zone at a rate of flow subject to variation as described below; controlling the rate at which a solvent stream is supplied to said extraction zone at a previously established constant value; establishing an interface at a previously determined location in the extraction zone between a heavy phase which occupies a lower portion of the extraction zone and a light phase which occupies an upper portion of the extraction zone; varying the rate at which a stream of said heavy phase is withdrawn from said extraction zone lower portion in order to maintain said interface at a previously determined location; withdrawing a stream of said light phase from said extraction zone upper portion and dividing said light phase stream into first and second portions; establishing a recycle stream which consists of said first portion of said light phase stream and ocntinuously supplying said recycle stream to the extraction zone at substantially the same location at which the charge mixture stream is supplied; varying the rate of flow of said recycle stream in response to variation in a composition, said composition being characteristic of the performance of said extraction zone; maintaining a combined rate of flow into the extraction zone at a previously determined constant value, which combined rate of flow consists of the sum of the flow rates of said recycle stream and said charge mixture stream, thereby causing said charge mixture stream flow rate to vary inversely with said recycle stream flow rate; and varying the rate of flow of said second portion of said light phase stream, which remains after establishment of the recycle stream, in order to maintain volumetric inventory of the extraction zone at a constant value. Certain of the additional control actions discussed above may also be used in conjunction with this embodiment. These include control of solvent to heavy phase ratio and adjustment of reflux flow in response to heavy phase composition.

In order to aid in an understanding of this embodiment, the differences from the above embodiments will be highlighted, using FIG. 1. In this embodiment, controller 7 of FIG. 1 is a flow controller and controller 11 of FIG. 1 is a pressure controller. The control loops perform in the same manner as described above. That is, the flow rate of the recycle stream is maintained at a previously determined constant value by means of the flow control loop and the volumetric inventory of the zone is maintained by the pressure control loop. In addition, a composition controller (not shown) measures composition of light phase in pipeline 9, or 10, or 6, and adjusts the set point of the flow controller associated with the recycle stream, in a conventional type of cascade control. Alternatively, the composition controller could directly adjust control valve 8. Another composition characteristic of the performance of the extraction zone which might be utilized for control in the same manner is composition of the heavy phase or a fraction thereof. Also, if a reflux stream is used, such stream provides a desirable location to monitor composition. It can be seen that when the aromatics profile in the extraction zone moves upward in response to an upset, the composition controller will sense an increase in aromatics content and increase recycle flow, as described above.

Where parameters are described as controlled at a previously described constant value, it is to be understood that the parameters may vary above and below the constant value in a range. Such variation is an inherent characteristic of control loops of the type utilized in the detailed example. A value measured by a controller is compared to a previously established value entered into the controller and, if the comparison shows a difference between the values, a signal which is continuously transmitted to a control valve is varied in a manner related to the difference, such that the valve moves to change the measured value back to the previously established value. A single disturbance in a controlled parameter often causes the parameter to fluctuate in a range for a short time, the excursions above and below the previously established control valve becoming smaller with time until they cease.

The present invention has been described in terms of conventional analog control equipment which does not utilize microprocessors. This is not intended to limit the scope of the invention. Control computers, microprocessor-based instruments, composition analyzers, etc. may be utilized in the practice of the invention or the steps of the invention may be performed manually.

I claim as my invention:

1. A method of operation for a continuous countercurrent extraction zone, to which a charge mixture stream and a solvent stream are continuously supplied and from which an extract stream and a raffinate stream are continuously withdrawn, said method of operation comprising:

(a) passing a charge mixture stream into an extraction zone at a rate of flow subject to variation as described in step (h);

(b) controlling the rate at which a solvent stream is supplied to said extraction zone at a previously established constant value;

(c) establishing an interface at a previously determined location in the extraction zone between a heavy phase which occupies a lower portion of the extraction zone and a light phase which occupies an upper portion of the extraction zone;

(d) varying the rate at which a stream of said heavy phase is withdrawn from said extraction zone lower portion in order to maintain said interface at a previously determined location;

(e) withdrawing a stream of said light phase from said extraction zone upper portion and dividing said light phase stream into first and second portions;

(f) establishing a recycle stream which consists of said first portion of said light phase stream and continuously supplying said recycle stream to the extraction zone at substantially the same location at which the charge mixture stream is supplied;

(g) varying the rate of flow of said recycle stream in order to maintain volumetric inventory of the extraction zone at a constant value;

(h) maintaining a combined rate of flow into the extraction zone at a previously determined constant value, which combined rate of flow consists of the sum of the flow rates of said recycle stream and said charge mixture stream, thereby causing said charge mixture stream flow rate to vary inversely with said recycle stream flow rate; and, (i) controlling the rate of flow of said second portion of said light phase stream, which remains after establishment of the recycle stream, at a previously determined constant value.

2. The method of claim 1 further characterized in that said heavy phase stream is extract and said light phase stream is raffinate.

3. The method of claim 1 further characterized in that said light phase stream is extract and said heavy phase is raffinate.

4. The method of claim 1 further characterized in that said solvent stream comprises a sulfolane-type compound.

5. The method of claim 1 further characterized in that said solvent stream comprises a glycol-type compound.

6. The method of claim 1 further characterized in that said charge mixture stream comprises aromatic hydrocarbons and nonaromatic hydrocarbons.

7. The method of claim 1 further characterized with respect to step (g) in that an indicium of said volumetric inventory in the extraction zone is pressure in the extraction zone.

8. The method of claim 1 further characterized with respect to step (g) in that an indicium of said volumetric inventory in the extraction zone is level of liquid in the upper portion of the extraction zone, said liquid level being established by maintaining a quantity of a gas at a previously established constant pressure in said upper portion above said liquid level.

9. The method of claim 1 further characterized with respect to step (h) in that said recycle stream and said charge mixture stream are combined to form a single combined feed stream which is supplied to the extraction zone.

10. The method of claim 1 further characterized in that a reflux stream comprising light aromatic and nonaromatic hydrocarbons is supplied to the extraction zone, which reflux stream comprises a portion of said heavy phase stream.

11. The method of claim 10 further including adjusting the flow rate of said reflux stream in response to variation in composition of said heavy phase, said heavy phase composition being measured at a location downstream of said interface.

12. The method of claim 10 further including adjusting the flow rate of said reflux stream in response to variation in composition of a portion of said heavy phase stream remaining after said reflux stream is separated from said heavy phase stream.

13. The method of claim 10 further including adjusting said previously determined constant value at which said flow rate of said second portion of said light phase stream is controlled, as set forth in claim 1(i), in response to variation in composition of said reflux stream.

14. The method of claim 1 further including maintaining a ratio at a previously established constant value, which ratio is formed by dividing said solvent stream flow rate by said heavy phase stream flow rate, said ratio being maintained by adjusting said previously established constant value at which said solvent stream is controlled, as set forth in claim 1(b), in response to variation in the flow rate of said heavy phase stream withdrawn from said extraction zone lower portion as set forth in step (d) of claim 1.

15. A method of operation for a continuous countercurrent extraction zone, to which a charge mixture stream and a solvent stream are continuously supplied and from which an extract stream and a raffinate stream are continuously withdrawn, said method of operation comprising:

(a) passing a charge mixture stream into an extraction zone at a rate of flow subject to variation as described in step (h);

(b) controlling the rate at which a solvent stream is supplied to said extraction zone at a previously established constant value;

(c) establishing an interface at a previously determined location in the extraction zone between a heavy phase which occupies a lower portion of the extraction zone and a light phase which occupies an upper portion of the extraction zone;

(d) varying the rate at which a stream of said heavy phase is withdrawn from said extraction zone lower portion in order to maintain said interface at a previously determined location;

(e) withdrawing a stream of said light phase from said extraction zone upper portion and dividing said light phase stream into first and second portions;

(f) establishing a recycle stream which consists of said first portion of said light phase stream and continuously supplying said recycle stream to the extraction zone at substantially the same location at which the charge mixture stream is supplied;

(g) varying the rate of flow of said recycle stream in response to variation in a composition, said composition being characteristic of the performance of said extraction zone;

(h) maintaining a combined rate of flow into the extraction zone at a previously determined constant value, which combined rate of flow consists of the sum of the flow rates of said recycle stream and said charge mixture stream, thereby causing said charge mixture stream flow rate to vary inversely with said recycle stream flow rate; and, (i) varying the rate of flow of said second portion of said light phase stream, which remains after establishment of the recycle stream, in order to maintain volumetric inventory of the extraction zone at a constant value.

16. The method of claim 15 further characterized in that said composition which is characteristic of extraction zone performance is the composition of said light phase stream.

17. The method of claim 15 further characterized in that a reflux stream comprising light aromatic and nonaromatic hydrocarbons is supplied to the extraction zone, which reflux stream comprises a portion of said heavy phase stream.

18. The method of claim 17 further including adjusting the flow rate of said reflux stream in response to variation in composition of said heavy phase, said heavy phase composition being measured at a location downstream of said interface.

19. The method of claim 17 further characterized in that said composition which is characteristic of extraction zone performance is the composition of said reflux stream.

20. The method of claim 15 further including maintaining a ratio at a previously established constant value, which ratio is formed by dividing said solvent stream flow rate by said heavy phase stream flow rate, said ratio being maintained by adjusting said previously established constant value at which said solvent stream is controlled, as set forth in claim 15(b), in response to variation in the flow rate of said heavy phase stream withdrawn from said extraction zone lower portion as set forth in step (d) of claim 1.

* * * * *